US006871399B2

(12) United States Patent
Iwasaki et al.

(10) Patent No.: US 6,871,399 B2
(45) Date of Patent: Mar. 29, 2005

(54) METHOD FOR PRODUCING AN INTEGRATED HEAT EXCHANGER AND AN INTEGRATED HEAT EXCHANGER PRODUCED THEREBY

(75) Inventors: Mitsuru Iwasaki, Tokyo (JP); Kazunori Namai, Tokyo (JP); Hiroshi Chikuma, Tokyo (JP)

(73) Assignee: Calsonic Kansei Corporation, Tokyo (JP)

( * ) Notice: Subject to any disclaimer, the term of this patent is extended or adjusted under 35 U.S.C. 154(b) by 170 days.

(21) Appl. No.: 10/350,360

(22) Filed: Jan. 24, 2003

(65) Prior Publication Data

US 2004/0031595 A1 Feb. 19, 2004

(30) Foreign Application Priority Data

Jan. 25, 2002 (JP) ..... P2002-016837
Apr. 8, 2002 (JP) ..... P2002-105448

(51) Int. Cl.[7] ..... B21D 53/02

(52) U.S. Cl. ..... 29/890.03; 29/890.041; 29/890.07; 165/146; 165/61; 165/135

(58) Field of Search ..... 29/890.03, 890.041, 29/412, 413, 414, 415, 417, 890.07; 165/61, 51, 146, 135, DIG. 18, DIG. 15

(56) References Cited

U.S. PATENT DOCUMENTS 5,033,540 A * 7/1991 Tategami et al. ..... 165/135
5,509,199 A * 4/1996 Beamer et al. ..... 29/890.07
5,732,460 A * 3/1998 Paternoster et al. ..... 29/727
6,354,368 B1 * 3/2002 Nishishita et al. ..... 165/135
6,360,817 B1 * 3/2002 Brochin et al. ..... 165/140
6,502,305 B2 * 1/2003 Martins et al. ..... 29/890.047
6,561,264 B2 * 5/2003 Ozaki et al. ..... 165/140

* cited by examiner

*Primary Examiner*—David P. Bryant
*Assistant Examiner*—Stephen Kenny
(74) *Attorney, Agent, or Firm*—Foley & Lardner LLP

(57) ABSTRACT

In a fin forming step, fins of heat exchangers are formed into a connected state where the fins are connected to each other via a parting portion. In a fin attaching step, the fins in the connected state are temporarily attached to the respective heat exchangers. In a fin fixing step, an integrated heat exchanger in which the fins are temporarily attached is passed through a heating oven to braze the fins to the respective heat exchangers. In a fin separating step W4, the fins in the connected state of the respective heat exchangers are separated from each other in the parting portion. Therefore, each of the heat exchangers can independently perform a heat exchanging operation without being affected by heat conduction from the other heat exchanger via the fins.

6 Claims, 12 Drawing Sheets

METHOD FOR PRODUCING AN INTEGRATED HEAT EXCHANGER AND AN INTEGRATED HEAT EXCHANGER PRODUCED THEREBY

The present disclosure relates to the subject matter contained in Japanese Patent Application No. 2002-16837 filed on Jan. 25, 2002 and Japanese Patent Application No. 2002-105448 filed on Apr. 8, 2002, which are incorporated herein by reference in its entirety.

BACKGROUND OF THE INVENTION

1. Field of the Invention

The present invention relates to a method for producing an integrated heat exchanger in which a plurality of heat exchangers each having a heat radiation fin are coupled to each other in a stacking direction, and to an integrated heat exchanger produced by such a method.

2. Description of the Related Art

As shown in FIG. 14, an integrated heat exchanger according to a related art includes, for example, a radiator 1 and a condenser 2, which are coupled to each other in a stacking direction. The radiator 1 cools cooling water for an engine. The condenser 2 is used in a refrigeration cycle of an air conditioner.

The radiator 1 and the condenser 2 have pairs of tanks 3 and 3*a*, and 4 and 4*a*, which are called headers, respectively. The radiator 1 and the condenser 2 have a structure in which a plurality of tubes 5 communicate between the tanks 3 and 3*a* and between 4 and 4*a*, and fins 6 are interposed between the tubes 5 to be joined thereto. In the figure, the tubes and the fins of the condenser 2 are not shown.

Each of the fins 6, which are used in the radiator 1 and the condenser 2 is configured as a louver fin as shown in FIG. 15. A strip thin sheet P of aluminum is formed into a corrugated shape (bellows-like shape) in which bent portions 6*a* and flat portions 6*b* are alternately continued. A plurality of louvers 7 are punched and raised in each of the flat portions 6*b* along a longitudinal direction Y of the strip thin sheet P to be juxtaposed in a lateral direction X of the strip thin sheet P.

If the punched and raised directions of the louvers 7 of the louver fin 6 are unbalanced in the lateral, direction X, the whole of the louver fin 6 is curved and rounded as shown in FIG. 16 by difference in amount of distortion generated in the raised portions.

As shown in FIG. 15, therefore, the louvers 7 are formed in the flat portions 6*b* so as to be symmetrical in number and the raised direction (opening direction) with respect to a center portion in the lateral direction X, so that the distortion amounts are balanced in the lateral direction X. Whereby the louver fin 6 can be prevented from being curved.

On the other hand, in the fins 6, which are to be incorporated into the radiator 1 and the condenser 2 of the integrated heat exchanger, it is preferable to set the opening directions of the louvers 7 in each of the heat exchangers constant in order to reduce the flow resistance of the air.

In order to set the opening directions of the louvers 7 constant while preventing the fin 6 to be incorporated into the radiator 1 and the condenser 2 from being curved, therefore, one side portion A in the lateral direction X of the louver fin 6 shown in FIG. 15 can be used in the radiator 1, and the other side portion B can be used in the condenser 2. In this case, the fin of the radiator 1, and that of the condenser 2 are formed in a state where the fins are connected to each other across the center portion in the lateral direction X.

However, when the louver fin 6 in which the fins (the portions A and B) are formed are attached to the radiator 1 and the condenser 2 of the integrated heat exchanger, a state is caused where the fin (the portion A) of the radiator 1 is connected to the fin (the portion B) of the condenser 2. Consequently, the heat of the radiator 1 flows into the condenser 2 through the connecting portion, thereby lowering the heat exchange efficiency of the condenser 2.

Therefore, a technique is attempted in which, although not shown, a slit is formed in the connecting portion to reduce the amount of heat conduction. Also in this case where a slit is formed, in order to prevent the louver fin 6 from being curved, it is essential to connect the fin of the portion A with that of the portion B. As a result, connecting portions are formed at adequate intervals in the slit, and heat conduction is performed through the connecting portions.

SUMMARY OF THE INVENTION

The invention has been conducted in view of the problems in the related art. It is an object of the invention to provide a method for manufacturing an integrated heat exchanger in which if fins in a connected state are incorporated into a plurality of heat exchangers, the fins are finally separatedly provided to the respective heat exchangers to prevent heat conduction from occurring between the heat exchangers through the fins, and also such an integrated heat exchanger.

According to a first aspect of the invention, there is provided a method for producing an integrated heat exchanger in which a plurality of heat exchangers each having a fin for heat radiation are coupled to each other in a stacking direction. The method includes the steps of forming the fins of the heat exchangers into a connected state where the fins are connected to each other via a parting portion, temporarily attaching the fins in the connected state to the heat exchangers, respectively, heating the integrated heat exchanger in which the fins are temporarily attached, to braze the fins to the heat exchangers, respectively, and separating the fins in the connected state from each other along the parting portion.

According to a second aspect of the invention, the method of the first aspect further includes the steps of applying a fusing material to the parting portion before the heating step, the fusing material fusing the fins when being heated.

According to a third aspect of the invention, in the second aspect, the fins are made of aluminum thin sheets. The fusing material is a brazing material. In the applying step, the brazing material is applied to the parting portion so that an amount of the brazing material is larger than a brazing allowable amount at which a brazing process can be normally performed.

According to a fourth aspect of the invention, in the third aspect, the applying step includes the steps of applying a first brazing material to the parting portion, and applying a second brazing material to the fins in a stripe manner.

According to a fifth aspect of the invention, the method of the first aspect further includes the steps of forming each of fins into a corrugated shape in which flat having louvers and bent portions are alternately formed. The parting portion is a perforated line in which connecting parts are formed at the bent portions.

According to a sixth aspect of the invention, the method of the first aspect further includes the steps of providing a coupling flow portion, which flows a heat exchange medium from the heat exchanger on one end side in the stacking direction to the heat exchanger on another end side in the stacking direction therethrough.

According to a seventh aspect of the invention, there is provided an integrated heat exchanger including a plurality of heat exchangers, which are coupled to each other in a stacking direction, and fins attached to the heat exchangers, respectively. The fins are separated from each other.

According to an eighth aspect of the invention, in the seventh aspect, the fins in a connected state where the fins are connected to each other via a parting portion are attached to the heat exchangers and then the fins are separated from each other in the parting portion.

According to a ninth aspect of the invention, in the seventh aspect, number of the fins is even number. Louvers are formed in the fins in line symmetric manner with each other.

According to a tenth aspect of the invention, the integrated heat exchanger of the seventh aspect further includes a coupling flow portion, which flows a heat exchange medium from the heat exchanger on one end side in the stacking direction to the heat exchanger on another end side in the stacking direction therethrough.

According to the first aspect, the fins of the plural heat exchangers are formed into a connected state via the parting portion in the fin forming step, the fins in the connected state are temporarily attached and brazed to the heat exchangers in the fin attaching step and the fin fixing step, and, in the fin separating step, the fins in the connected state are finally separated in the parting portion from each other. In the completed state of the integrated heat exchanger, therefore, the fins of the heat exchangers can be separated from each other.

Therefore, heat conduction between the heat exchangers via the fins can be completely prevented from occurring, and each of the heat exchangers can independently perform a heat exchanging operation without being largely affected by heat conduction from the other heat exchanger(s). As a result, the whole heat exchange performance of the integrated heat exchanger can be enhanced.

The second aspect of the invention can attain the following effect in addition to the effect of the first aspect of the invention. The fusing material which fuses the fin material by heating is used and previously applied to the parting portion of the fins, and the integrated heat exchanger is then passed through the heating oven, whereby separation of the fins can be performed simultaneously with the brazing of the fins, so that the production steps can be simplified.

The third aspect of the invention can attain the following effect in addition to the effects of the second aspect of the invention. Since the fin material is an aluminum thin sheet, the weight of the heat exchangers can be reduced. The invention uses the characteristic that, in the case where the base material is an aluminum thin sheet, the base material is fused when a brazing material is used in an amount that is larger than an allowable amount which is employed in a usual brazing process. Since the brazing material is used as the fusing material, the fins can be separated in the parting portion by the heating temperature during the brazing process, so that the fin production line can be simplified.

The fifth aspect of the invention can attain the following effects in addition to the effects of the first to third aspects of the invention. The separated portion in the parting portion can be restricted only to the connecting parts which are placed in the bent portions. Since the bent portions constitute ridges and valleys of the corrugated fins, the separation work can be easily performed. In the case where a fusing material is used, particularly, the work of applying the fusing material can be easily performed.

The sixth aspect of the invention can attain the following effect in addition to the effects of the first to fifth aspects of the invention. The coupling flow portion disposed in the plural heat exchangers which are coupled to each other in the stacking direction enables the heat exchange medium to flow from one of the heat exchangers on one end side in the stacking direction to another one of the heat exchangers on another end side. Therefore, the heat exchange medium is cooled by each of the plural stacked heat exchangers. As a result, the heat exchange efficiency is improved, so that the integrated heat exchanger can be made compact and the cooling efficiency can be enhanced.

According to the seventh aspect of the invention, the integrated heat exchanger can be configured in the state where the fins of the heat exchangers are separated from each other. Therefore, heat conduction between the heat exchangers via the fins can be prevented from occurring.

The ninth aspect of the invention can attain the following effect in addition to the effect of the seventh aspect of the invention. Since the louvers in the even number of fins of the heat exchangers are made symmetrical, the distortion amount in the state where the fins are connected to each other via the parting portion is balanced in the lateral direction of the fins. Therefore, the fins can be formed while the linearity is maintained as a whole, and hence the fins can be easily attached.

The tenth aspect of the invention can attain the following effect in addition to the effects of the seventh to ninth aspects of the invention. The coupling flow portion disposed in the plural heat exchangers which are coupled to each other in the stacking direction enables the heat exchange medium to flow from one of the heat exchangers on one end side in the stacking direction to another one of the heat exchangers on another end side. Therefore, the heat exchange medium is cooled by each of the plural stacked heat exchangers. As a result, the heat exchange efficiency is improved, so that the integrated heat exchanger can be made compact and the cooling efficiency can be enhanced.

DETAILED DESCRIPTION OF THE PREFERRED EMBODIMENTS

Hereinafter, embodiments of the invention will be described in detail with reference to the accompanying drawings.

(First Embodiment)

Figure 1:
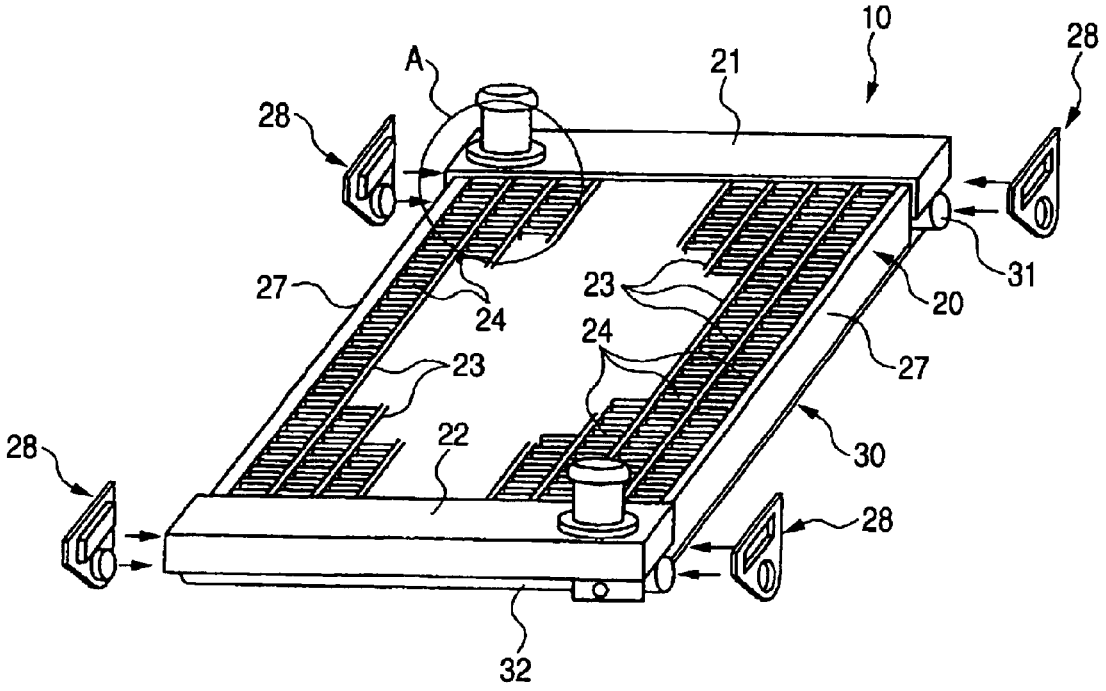
FIG. 1 is a perspective view showing an intermediate step of a process of assembling an integrated heat exchange according to a first embodiment of the invention.
Figure 2:
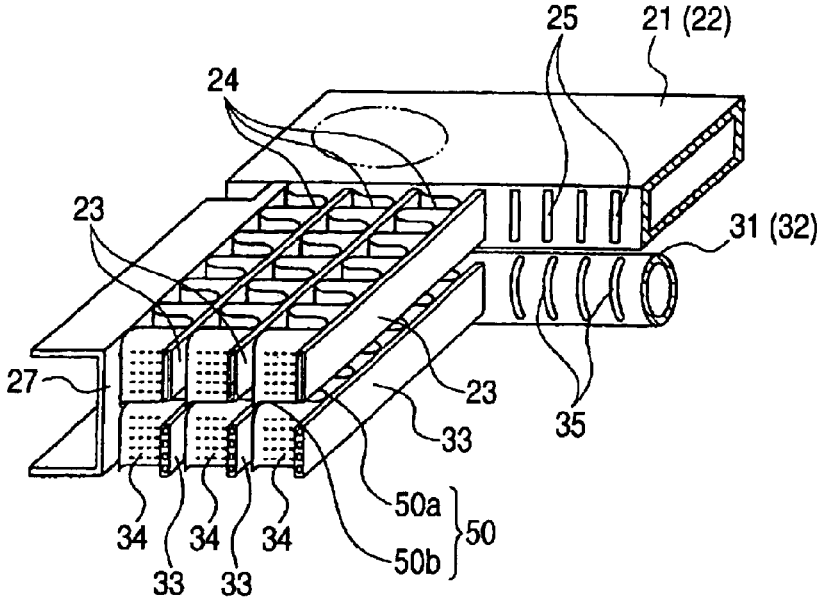
FIG. 2 is an enlarged perspective view of an area A in FIG. 1.
Figure 3:
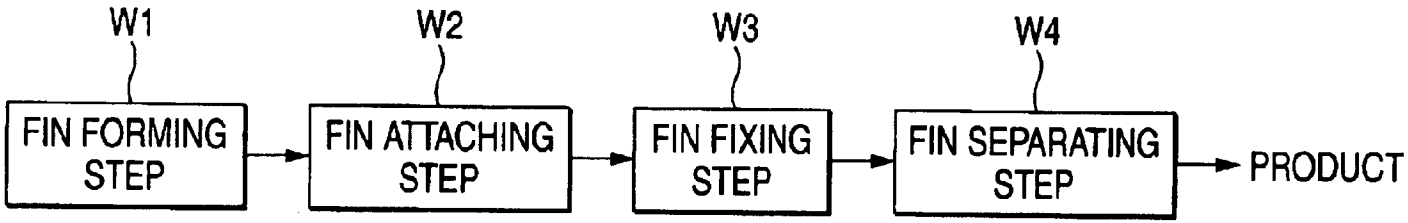
FIG. 3 is a flow chart showing a production procedure of the integrated heat exchanger according to the first embodiment of the invention.
Figure 4:
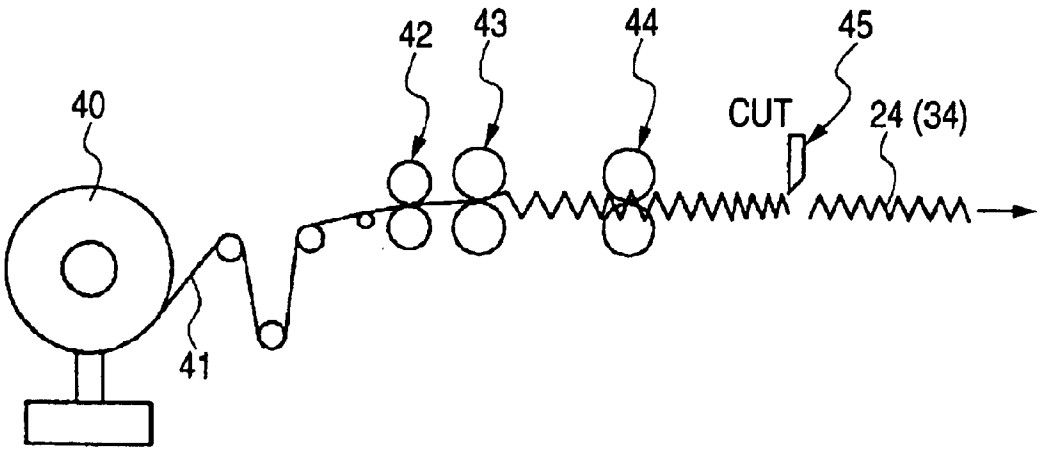
FIG. 4 is a diagram showing a fin forming step in the first embodiment of the invention.
Figure 5:
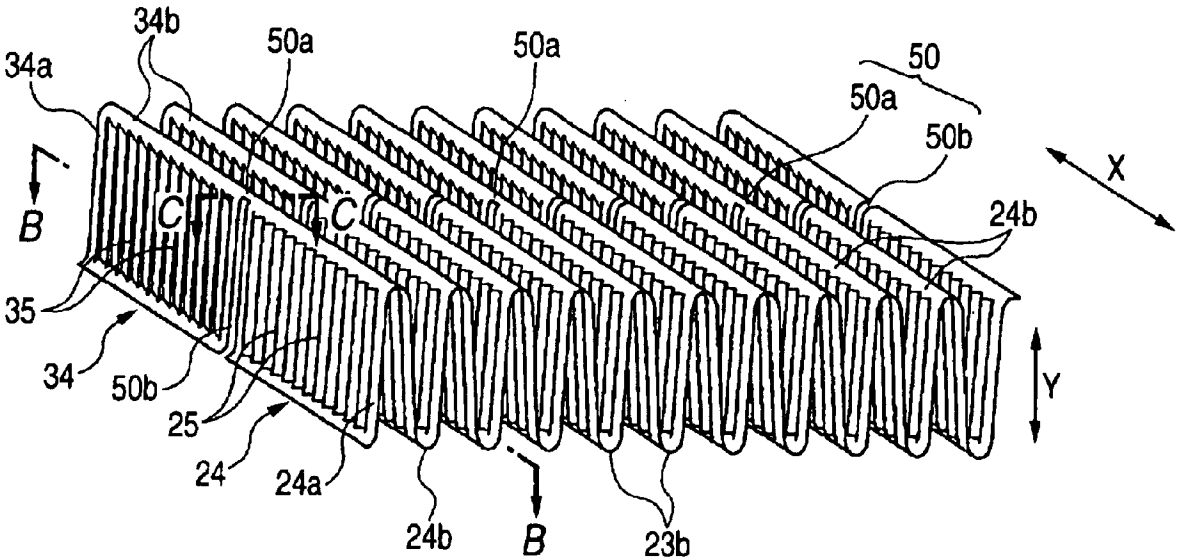
FIG. 5A is a perspective view showing a part of fins, which are formed in the fin forming step in the first embodiment of the invention.
FIG. 5B is a section view taken along a line C—C in FIG. 5A.
Figure 5:
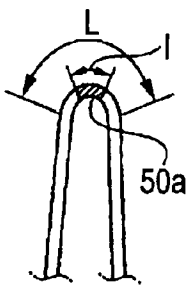
Figure 6:
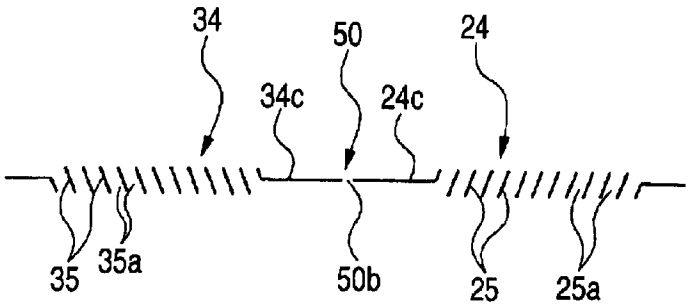
FIG. 6 is an enlarged section view taken along a line B—B in FIG. 5A.
Figure 7:
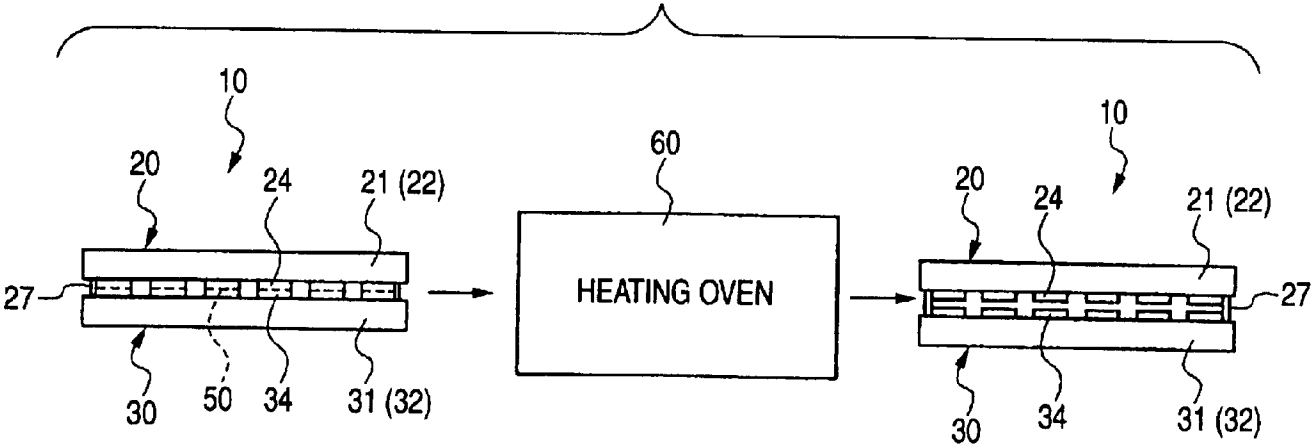
FIG. 7 is a diagram schematically showing a fin fixing step in the first embodiment of the invention.
Figure 8:
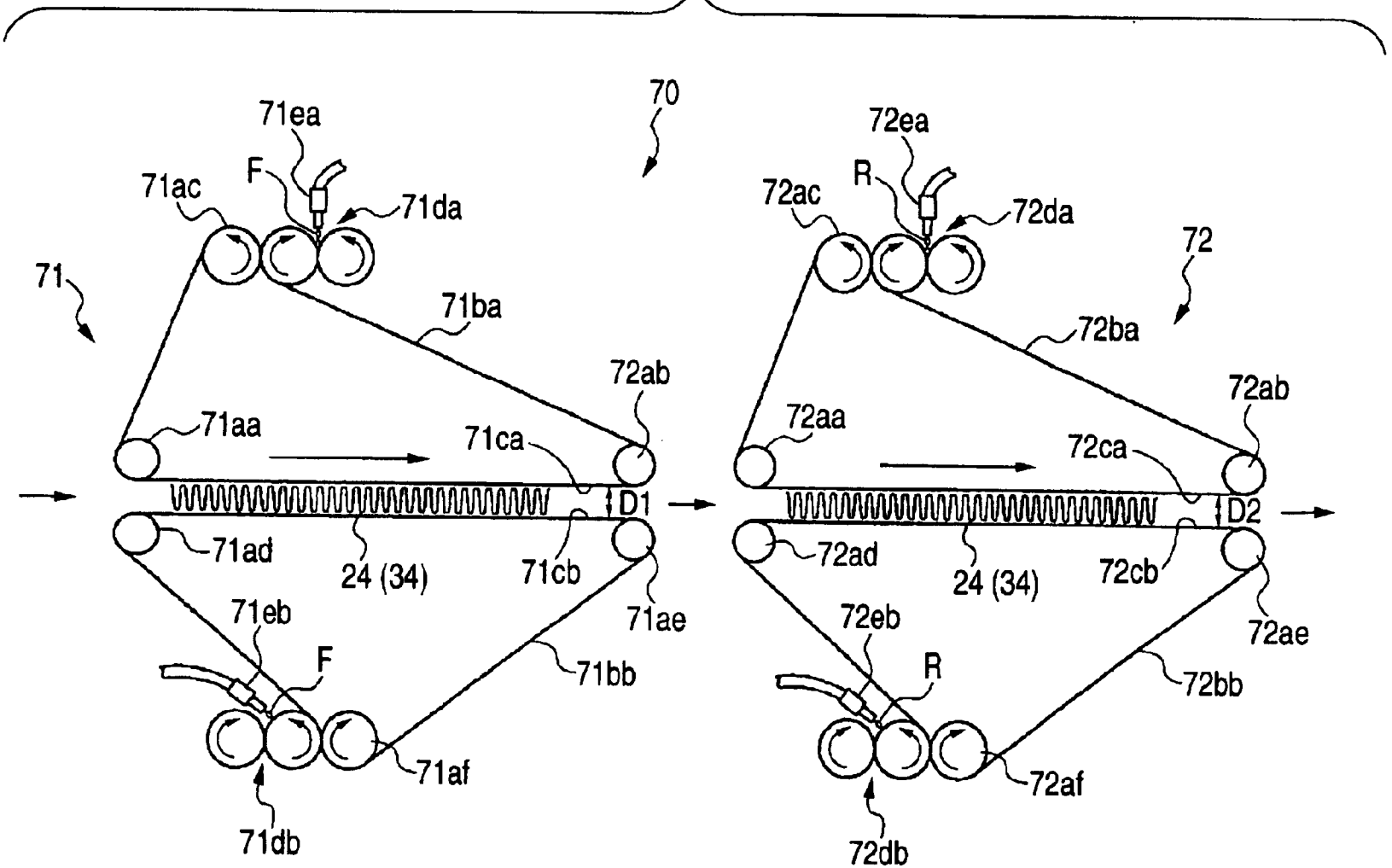
FIG. 8 is a diagram showing a brazing material applying step, which is conducted in a fin separating step in the first embodiment of the invention.
Figure 9:
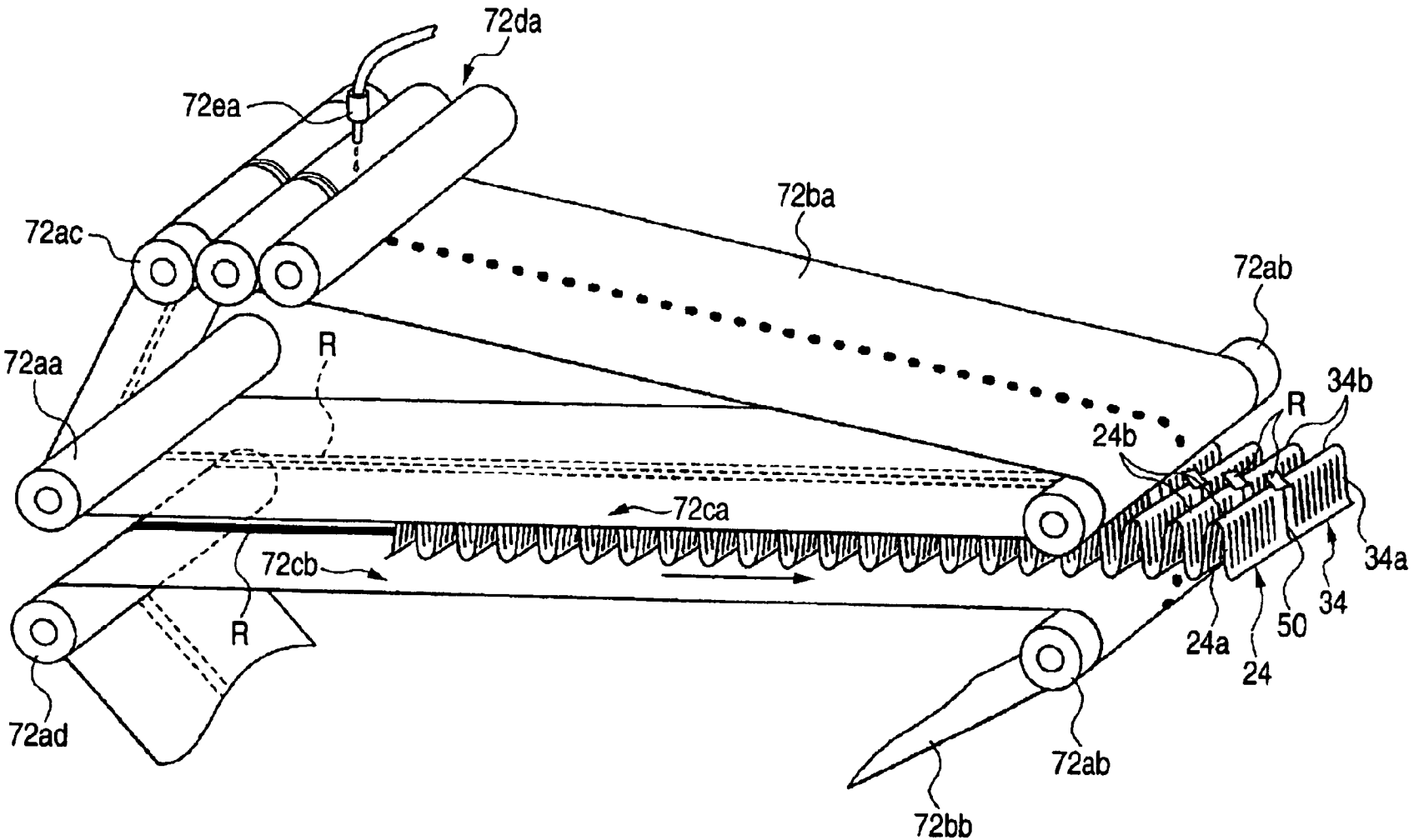
FIG. 9 is a perspective view showing brazing material applying belts, which are used in the brazing material applying step in the first embodiment of the invention.
Figure 10:
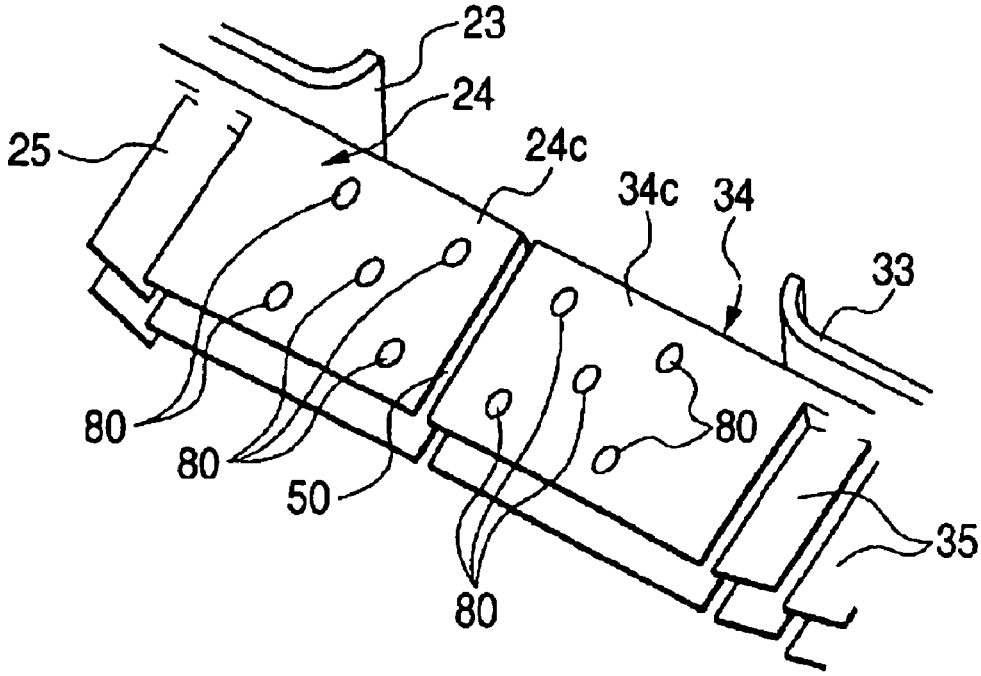
FIG. 10 is a perspective view showing separation end portions of the fins in the first embodiment of the invention.

FIGS. 1 to 10 show a method for producing an integrated heat exchanger according to a first embodiment of the invention and the integrated heat exchanger produced by the method. FIG. 1 is a perspective view showing an intermediate step of a process of assembling the integrated heat exchanger. FIG. 2 is an enlarged perspective view of an area A in FIG. 1. FIG. 3 is a flow chart showing a production procedure of the integrated heat exchanger. FIG. 4 is a diagram showing a fin forming step. FIG. 5 is a perspective view showing a part of fins, which are formed in the fin forming step. FIG. 6 is an enlarged section view taken along a line B—B in FIG. 5. FIG. 7 is a diagram schematically showing a fin fixing step. FIG. 8 is a diagram showing a brazing material applying step, which is conducted in a fin separating step. FIG. 9 is a perspective view showing brazing material applying belts, which are used in the brazing material applying step. FIG. 10 is a perspective view showing separation end portions of the fins.

As shown in FIG. 1, an integrated heat exchanger 10 according to the first embodiment is configured so that two heat exchangers, that is, a radiator 20 and a condenser 30, which are made of aluminum and an aluminum alloy, are coupled to each other in a stacking direction in the same manner as that of the related art.

As shown also in FIG. 2, the radiator 20, which serves as one heat exchanger, generally includes a pair of first tanks 21, 22, a plurality of first tubes 23, 23, . . . , and first fins 24, 24, . . . . The pair of first tanks 21, 22 have a rectangular sectional shape. The plurality of first tubes 23, 23, . . . extend between the first tanks 21, 22 to communicate therewith. The first fins 24, 24, . . . are incorporated between the first tubes 23, 23, . . . , respectively.

The condenser 30, which serves as another heat exchanger, is configured in a substantially identically manner as the radiator 20. The condenser 30 generally includes a pair of second tanks 31, 32, a plurality of second tubes 33, 33, . . . , and second fins 34, 34, . . . . The pair of second tanks 31, 32 have a circular sectional shape. The plurality of second tubes 33, 33, . . . extend between the second tanks 31, 32 to communicate therewith. The second fins 34, 34, . . . are incorporated between the second tubes 33, 33, . . . , respectively.

FIG. 3 shows a flow of steps of the method for producing the integrated heat exchanger 10. The integrated heat exchanger 10 is produced by a fin forming step W1, a fin attaching step W2, a fin fixing step W3, and a fin separating step W4. The fin forming step W1 forms the first and second fins 24, 34 of the radiator 20 and the condenser 30 from one strip thin sheet in which both faces are clad by a brazing material, into a connected state where the fins are connected to each other via a perforated line 50 (see FIG. 5) serving as a parting portion. The fin attaching step W2 temporarily attaches the first and second fins 24, 34 in the connected state to the radiator 20 and the condenser 30, respectively. The fin fixing step W3 passes the integrated heat exchanger 10 in which the first and second fins 24, 34 are temporarily attached, through a heating oven 60, which will be described later, to braze the first and second fins 24, 34 to the radiator 20 and the condenser 30. The fin separating step W4 separates the first and second fins 24, 34 in the connected state to the radiator 20 and the condenser 30, from each other along the perforated line 50.

In the fin forming step W1, as shown in FIG. 4, a strip thin sheet 41 of aluminum, which is reeled out of a roll 40, is passed between perforation forming rolls 42 for forming the perforated line 50, and then passed between corrugation forming rolls 43, which corrugates the strip thin sheet 41. While pitch of the corrugation is being pressingly reduced by pitch adjusting rolls 44 in the next stage, the strip thin sheet is cut into a predetermined length by a cutting blade 45. As a result, as shown in FIG. 5A, the first and second fins 24, 34 are formed in the connected state.

The corrugation forming rolls 43 are a pair of rolls between which the strip thin sheet 41 is to be inserted, and on each of which a plurality of radial teeth (not shown) for corrugation are formed into a star-like shape. When the strip thin sheet 41 is passed between the opposed radial teeth, flat portions 24*a*, 34*a* and bent portions 24*b*, 34*b* are alternately formed in the strip thin sheet 41 as shown in FIG. 5A, so that the strip thin sheet is formed into a corrugated shape.

Alternatively, the perforation forming rolls 42 may be incorporated into the corrugation forming rolls 43 by forming blades for mainly shearing the flat portions 24*a*, 24*a*, . . . and 34*a*, 34*a* . . . , in a center portion of the corrugation forming rolls.

Punching-and-raising teeth, which are not shown, are formed on meshing faces of the radial teeth, so that louvers 25, 25, . . . and 35, 35, . . . shown in FIG. 5A are punched and raised from the flat portions 24*a*, 24*a*, . . . and 34*a*, 34*a* . . . , simultaneously while the strip thin sheet 41 is formed into the corrugation shapes.

As shown in FIG. 5A, the louvers 25, 25, . . . and 35, 35, . . . are formed so as to elongate in the longitudinal direction Y of the strip thin sheet 41, and juxtaposed in the lateral direction X. As shown in FIG. 6, the directions (raised directions) of openings 25*a*, 35*a* of the louvers 25, 35 are formed so as to be identical with each other, in the whole faces of the flat portions 24*a* and 34*a*.

Also when the directions of the openings 25*a*, 35*a* of the louvers 25, 35 are made identical in each of the flat portions 24*a* and 34*a* as described above, in the first fin 24 and the second fin 34, the directions of the openings 25*a*, 35*a* of the louvers 25, 35 are opposite to each other to be symmetric with respect to the perforated line 50.

The perforated line 50 is formed so that slits 50*b* have connecting parts 50*a* scattered at relatively large intervals. As shown in FIG. 5A, the connecting parts 50*a* are disposed in bent portions 24*b* (34*b*) at predetermined intervals (in the embodiment, in every four bent portions).

As shown in FIG. 5B, developed length l of each connecting part 50*a* in the longitudinal direction Y of the strip thin sheet 41 is shorter than developed length L of the bent portion. In the illustrated embodiment, the slits 50*b* of the perforated line 50 are formed into a cutaway shape having an adequate width. Alternatively, the slits may be formed simply as cut lines having no width.

In the fin attaching step W2, the first fins 24 and the second tins 34, which are formed in the connected state via the perforated line 50 in this way and have a predetermined length, are interposed between the tubes 23, 23, . . . of the radiator 20 and the tubes 33, 33, . . . of the condenser 30 to be temporarily attached thereto, while common reinforces 27 shown in FIG. 2 are placed in the end areas, respectively.

At this time, the first fins 24 and the second fins 34 are placed so that the directions of the openings 25*a*, 35*a* of the respective louvers 25, 35 are identical in the whole faces of the radiator 20 and the condenser 30.

Each end of the tanks 21, 22 of the radiator 20 and the tanks 31, 32 of the condenser 30 is closed by a common end plate 28. The radiator 20 and the condenser 30 are integrally coupled with each other by the common end plates 28 and the common reinforces 27.

In the fin fixing step W3, as shown in FIG. 7, the integrated heat exchanger 10, which has been assembled in the fin attaching step W2, is passed through a heating oven 60 to be heated, whereby a brazing process is performed. Of course, surface preparation is conducted to previously apply a flux material (resin flux) to a portion to which the brazing material is to be applied.

In the fin fixing step W3, the first fins 24 are brazed to the first tubes 23, 23, . . . of the radiator 20, and the second fins 34 to the second tubes 33, 33, . . . of the condenser 30, the first tubes 23, 23, . . . are brazed to the first tanks 21, 22, and the second tubes 33, 33, . . . to the second tanks 31, 32; and also brazing of the end plates 28 is simultaneously performed.

In the fin separating step W4, a brazing-material containing resin R, which serves as a fusing material for fusing the fin material, that is, the strip thin sheet 41 of aluminum by heating, is previously applied to the connecting parts 50*a* of the perforated line 50 in a brazing material applying step 70, which will be described later. The first fins 24 are fusingly separated from the second fins 34 by heat applied during the passage through the heating oven 60.

The embodiment uses the characteristic that when a base material is a thin sheet made of aluminum or an aluminum alloy and a brazing material is used in an amount that is larger than an allowable amount employed in a usual brazing process, the base material is fused.

In the embodiment, the total amount of the brazing material, which clads the both faces, and the brazing-material containing resin R, which is extra applied to the connecting parts 50*a* of the perforated line 50 in addition to the brazing material, is larger than the brazing allowable amount of the base material of the connecting parts 50*a*, whereby the connecting parts 50*a* are fused away.

FIG. 8 shows a brazing material applying step 70. First, the first fin 24 and the second fin 34, which have been formed in the connected state in the fin forming step W1, are passed between flux applying belts 71, and then passed between brazing material applying belts 72.

The flux applying belts 71 are configured so that an upper belt 71*ba*, which is wound around triangularly arranged rollers 71*aa*, 71*ab*, 71*ac*, is placed in the upper side, and a lower belt 71*bb*, which is wound around triangularly arranged rollers 71*ad*, 71*ae*, 71*af*, is placed in the lower side so as to be symmetrical with respect to the upper belt 71*ba*. The portion of the upper belt 71*ba* between the rollers 71*aa*, 71*ab*, and that of the lower belt 71*bb* between the rollers 71*ad*, 71*ae* are placed in parallel to each other with being separated by a predetermined distance D1. These portions serve as feeding portions 71*ca*, 71*cb*, respectively.

Upper double rollers 71*da* are placed in the vicinity of the roller 71*ac* so as to sandwich the wound upper belt 71*ba* therebetween, and lower double rollers 71*db* are placed in the vicinity of the roller 71*af* so as to sandwich the wound lower belt 71*bb* therebetween. The resin flux F, which is ejected from nozzles 71*ea*, 71*eb* to the upper and lower double rollers 71*da*, 71*db* is transferred to surfaces of the upper and lower belts 71*ba*, 71*bb*.

On the other hand, the brazing material applying belts 72 are configured in a manner similar to the flux applying belts 71. Namely, an upper belt 72*ba*, which is wound around triangularly arranged rollers 72*aa*, 72*ab*, 72*ac*, is placed in the upper side, and a lower belt 72*bb*, which is wound around triangularly arranged rollers 72*ad*, 72*ae*, 72*af*, is placed in the lower side so as to be symmetrical with respect to the upper belt 72*ba*. A portion of the upper belt 72*ba* between the rollers 72*aa*, 72*ab*, and that of the lower belt 72*bb* between the rollers 72*ad*, 72*ae* are placed in parallel to each other with being separated by a predetermined distance D2. These portions serve as feeding portions 72*ca*, 72*cb*, respectively.

Upper double rollers 72*da* are placed in the vicinity of the roller 72*ac* so as to sandwich the wound upper belt 72*ba* therebetween, and lower double rollers 72*db* are placed in the vicinity of the roller 72*af* so as to sandwich the wound lower belt 72*bb* therebetween. The brazing-material containing resin R which is ejected from nozzles 72*ea*, 72*eb* to the upper and lower double rollers 72*da*, 72*db* is transferred to the surfaces of the upper and lower belts 72*ba*, 72*bb*.

The film thickness of the resin flux, which is applied to the upper and lower belts 71*ba*, 71*bb* of the flux applying belts 71, is controlled by adjusting the roller gaps of the upper and lower double rollers 71*da*, 71*db*. By contrast, the film thickness of the brazing-material containing resin R, which is applied to the upper and lower belts 72*ba*, 72*bb* of the brazing material applying belts 72, is determined by the depths of grooves formed in the upper and lower belt-side rollers of the upper and lower double rollers 72*da*, 72*db*, respectively.

The brazing-material containing resin R, which is to be transferred to the upper and lower belts 72*ba*, 72*bb* of the brazing material applying belts 72, is applied in a linear shape from the grooves of the upper and lower belt-side rollers, which are respectively formed in correspondence with places where the perforated line 50 between the first and second fins 24, 34 passes as shown in FIG. 9. In the flux applying belts 71, although not illustrated, the resin flux F is applied in a strip-like shape to the upper and lower belts 71*ba*, 71*bb* so as to correspond to the widths of the fins.

In the brazing material applying step 70, at first, the first fin 24 and the second fin 34 are passed between the feeding portions 71*ca*, 71*cb* of the flux applying belts 71, and the resin flux F, which has been transferred to the surfaces of the upper and lower belts 71*ba*, 71*bb*, is applied to the bent portions 24*b*, 34*b* of the first and second fins 24, 34, which includes the connecting parts 50*a* of the perforated line 50.

Then, the first fin 24 and the second fin 34 to which the resin flux F has been applied is passed between the feeding portions 72*ca*, 72*cb* of the brazing material applying belts 72. The brazing-material containing resin R, which has been transferred to the surfaces of the upper and lower belts 72*ba*, 72*bb*, is applied to the connecting parts 50*a* to which the resin flux F has been applied.

The brazing-material containing resin R is applied to the connecting parts 50*a* of the perforated line 50 in the brazing material applying step 70 so that the total amount of the applied brazing material and the brazing material, which clads the connecting parts 50*a*, is larger than the brazing allowable amount at which the brazing process can be normally performed.

Thereafter, the first and second fins 24, 34 in which the resin flux F and the brazing-material containing resin R are applied to the connecting parts 50*a* of the perforated line 50 in this way is sent to the fin attaching step W2 to be subjected to the process of assembling the integrated heat exchanger 10 as described above. The integrated heat exchanger is then sent to the fin fixing step W3 to be passed through the heating oven 60.

Therefore, the integrated heat exchanger 10, which is assembled in the fin attaching step W2, is passed through the heating oven 60, so that the connecting parts 50*a* of the perforated line 50 are fused away by the heat of the heating oven 60. As shown in FIG. 7, the integrated heat exchanger 10 in a state where the first fins 24 are separated from the second fins 24 is taken out from the heating oven 60.

With respect to the integrated heat exchanger 10 according to the embodiment, in the first fin 24 and the second fin 34, which are separated from each other along the perforated line 50, end portions 24*c*, 34*c* between which the perforated line 50 has been formed are opposingly protruded from the first tube 23 of the radiator 20 and the second tube 33 of the condenser 30 as shown in FIG. 10, respectively. Dimples 80, which are outward expanded, are formed on each of the end portions 24*c*, 34*c*, so that turbulence is generated in the airflow, which is directed from the radiator 20 to the condenser 30. Thus, the heat radiation performance can be improved.

With the configuration, in the method for producing the integrated heat exchanger 10 according to the embodiment, the first fins 24 of the radiator 20 and the second fins 34 of the condenser 30 are formed in the connected state via the perforated line 50 in the fin forming step W1, the first and second fins 24, 34, which are formed in the connected state, are temporarily assembled into the integrated heat exchanger 10 in the fin attaching step W2, and the fins are then passed through the heating oven 60 in the fin fixing step W3 to be brazed as a whole.

In the integrated heat exchanger 10, which is produced in this way, the brazing-material containing resin R is applied in the fin separating step W4 to the connecting parts 50*a* of the perforated line 50 through which the first and second fins 24 and 34 are connected to each other so that the amount of the brazing material applied to the applied portion is larger than the brazing allowable amount at which the brazing process can be normally performed. The fins are then passed through the heating oven 60 so that the connecting parts 50*a* can be fused away so that the first and second fins 24 and 34 can be separated from each other.

In the radiator 20 and the condenser 30 of the integrated heat exchanger 10, therefore, heat conduction through the first and second fins 24 and 34 can be completely prevented from occurring. Therefore, each of the radiator 20 and the condenser 30 can independently perform a heat exchanging operation without being greatly affected by heat conduction from the other heat exchanger. As a result, the whole heat exchange performance of the integrated heat exchanger 10 can be enhanced.

The separation of the first fin 24 and the second fin 34 is realized by using the brazing-material containing resin R, applying the brazing-material containing resin R to the connecting parts 50*a* of the perforated line 50 so that the amount of the brazing material applied to the applied portion is larger than the brazing allowable amount, and then passing the fins through the heating oven 60. Therefore, the first and second tins 24 and 34 can be separated from each other along the perforated line 50 simultaneously with the brazing of the first and second fins 24 and 34 in the fin fixing step W3. As a result, the fin production line can be simplified.

In order to allow the first and second fins 24 and 34 to be separated from each other by the application of the brazing-material containing resin R, the first and second fins are formed of the strip thin sheet 41. According to this configuration, the weight of the integrated heat exchanger 10 can be reduced.

In the perforated line 50, which serves as the parting portion of the first and second fins 24 and 34, the connecting parts 50*a* are placed in the bent portions 24*b*, 34*b*. Since the bent portions 24*b*, 34*b* constitute ridges and valleys of the corrugated fins, the connecting parts 50*a* are exposed to the surface so that the separating work can be easily performed.

Particularly, the resin flux F and the brazing-material containing resin R can be applied to the connecting parts 50*a* simply by passing the first and second fins 24 and 34 between the upper and lower belts 71*ba*, 71*bb* of the flux applying belts 71 and between the upper and lower belts 72*ba*, 72*bb* of the brazing material applying belts 72. Therefore, the application work can be simplified.

Since each of the connecting parts 50*a* is formed so that the developed length l of in the longitudinal direction Y is shorter than the developed length L of the bent portion, the fins can be easily separated from each other. Moreover, the amount of the brazing material required for fusing away can be reduced.

In the integrated heat exchanger 10 according to the embodiment, the louvers 25 of the first fin 24 and the louvers 35 of the second fin 34 are symmetrical in the number of the louvers and the directions of the openings 24*a*, 35*a* with respect to the perforated line 50. In the formation of the first and second fins 24 and 34, therefore, the distortion amount in the state where the fins are connected to each other is balanced in the lateral direction X of the fins. As a result, the fins can be formed while the linearity of the whole is maintained, and hence the first and second fins 24, 34 can be easily attached to the radiator 20 and the condenser 30, respectively.

Even when the fin separating step W4 in the invention is omitted, the thermal influence between heat exchangers can be substantially eliminated by increasing the intervals of the connecting parts 50*a* or shortening the developed length l in the longitudinal direction Y in a range where the fin attaching steep W2 can be realized.

The invention has been described by way of the example in which the two heat exchangers, that is, the radiator 20 and the condenser 30 are coupled to each other to constitute the integrated heat exchanger 10. However, the kinds and number of heat exchangers to be coupled are not particularly limited to this example. The number of fins is adequately set in accordance with the number of heat exchangers to be coupled. In this case also, it is a matter of course that the fins are formed in a state where the fins are connected to each other via, the parting portion 50.

In the embodiment described above, the fin material is clad. Alternatively, in a case where the tubes are provided with a brazing material, a fin material, which is not clad by a brazing material, may be used. In this case also, the same effects can be attained by adjusting the application amount of the brazing-material containing resin.

(Second Embodiment)

Figure 11:
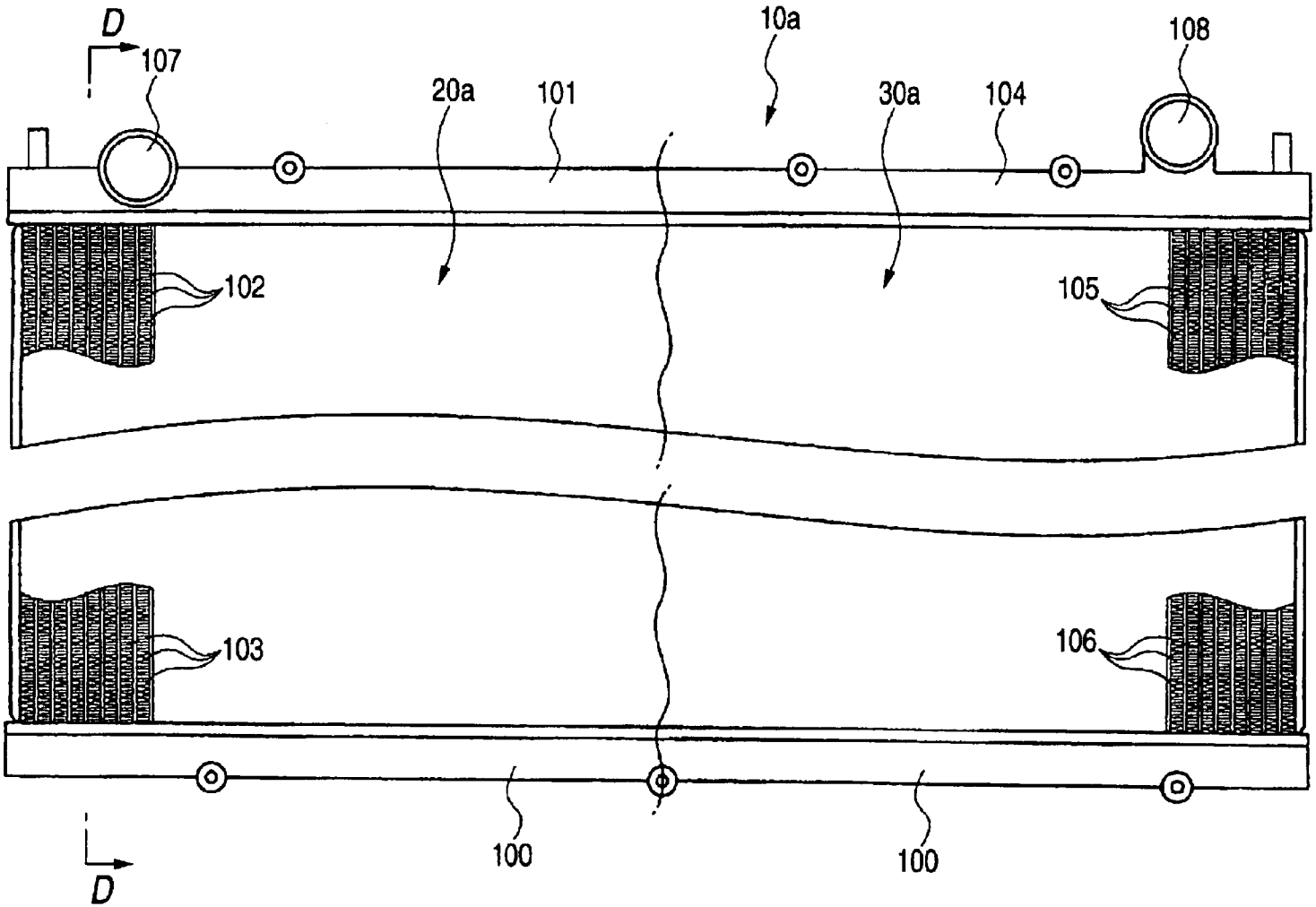
FIG. 11 is a front view of an integrated heat exchanger according to a second embodiment of the invention.
Figure 12:
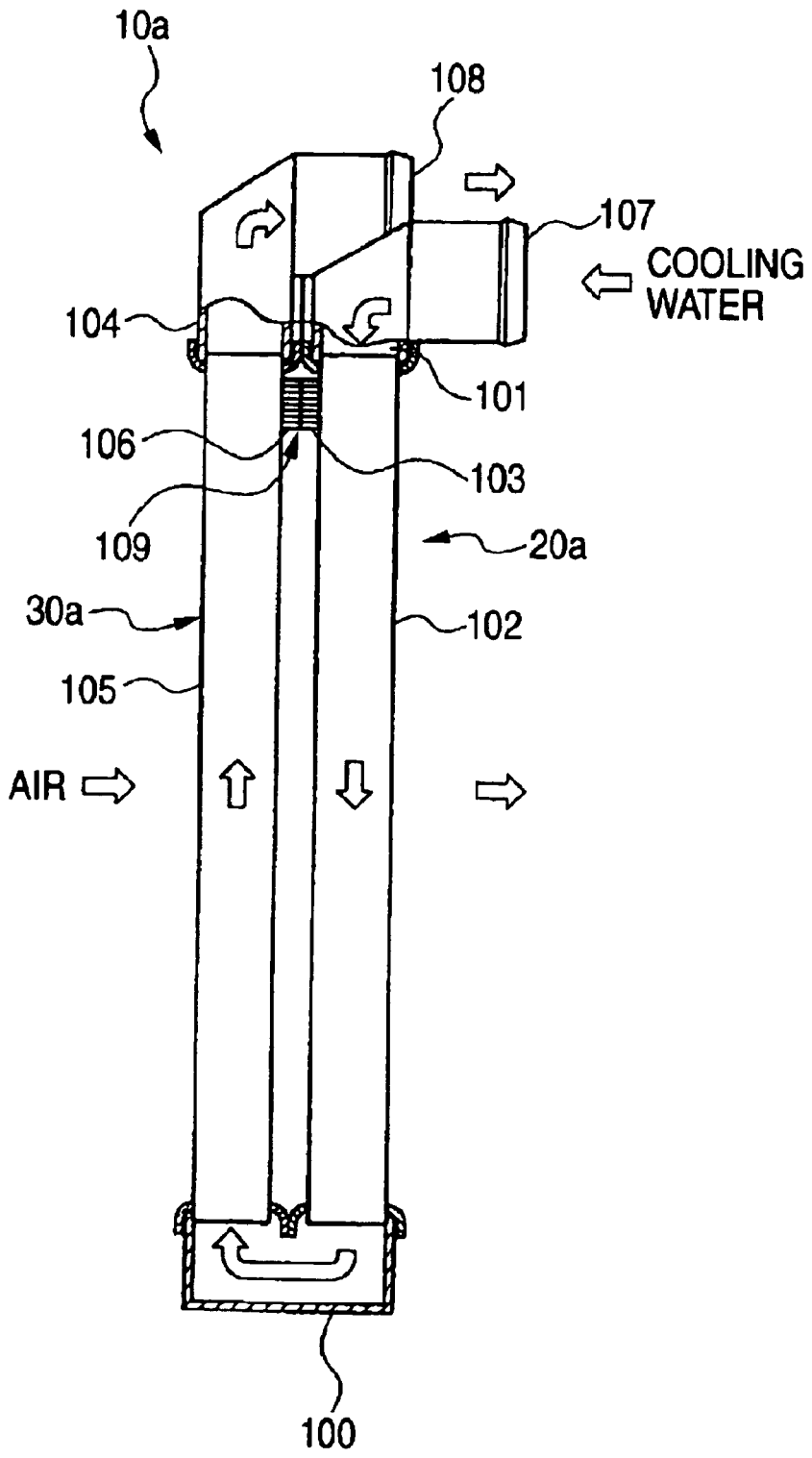
FIG. 12 is an enlarged section view taken along a line D—D in FIG. 11.
Figure 13:
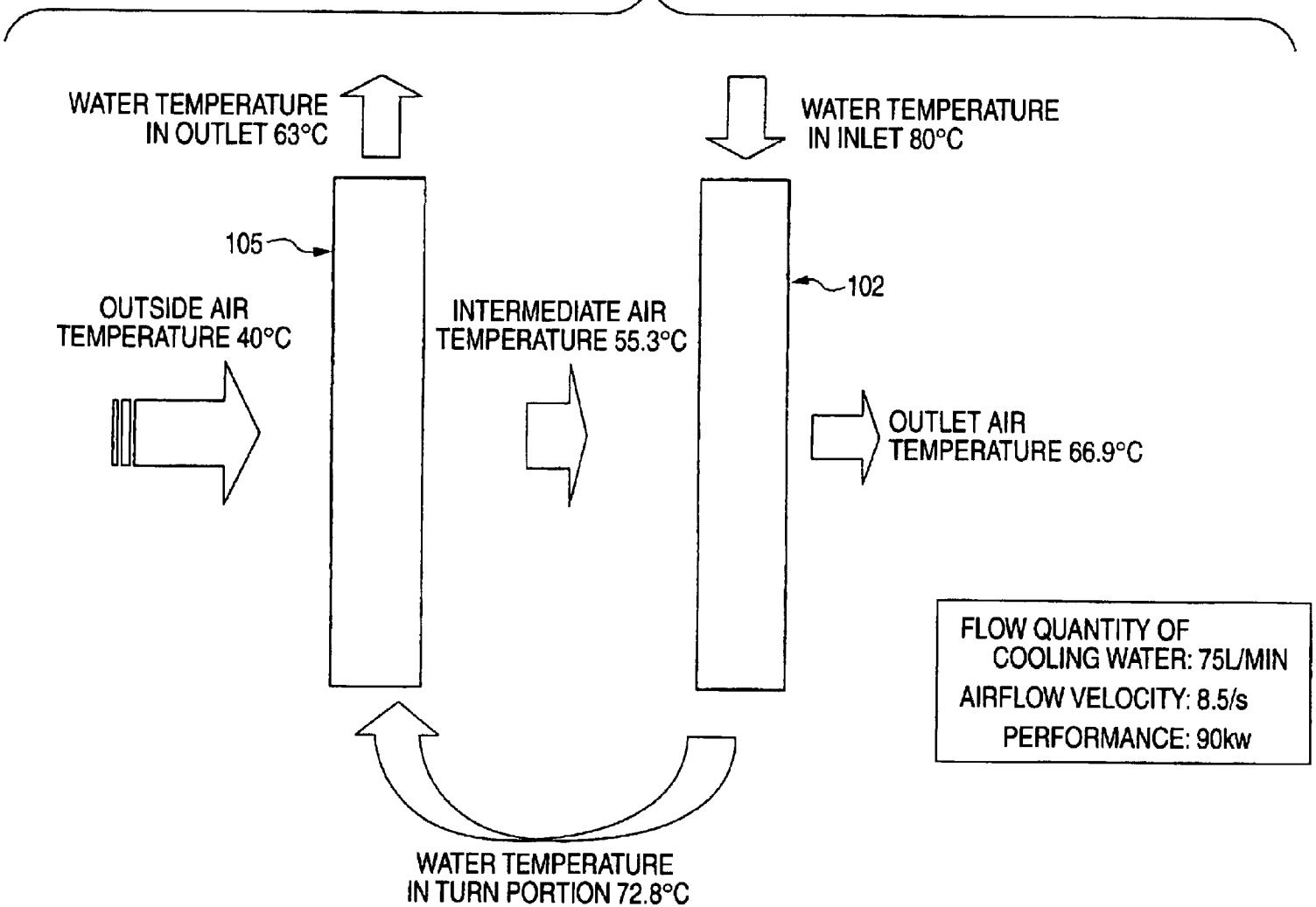
FIG. 13 is a diagram showing cooling performance of the integrated heat exchanger according to the second embodiment of the invention.
Figure 14:
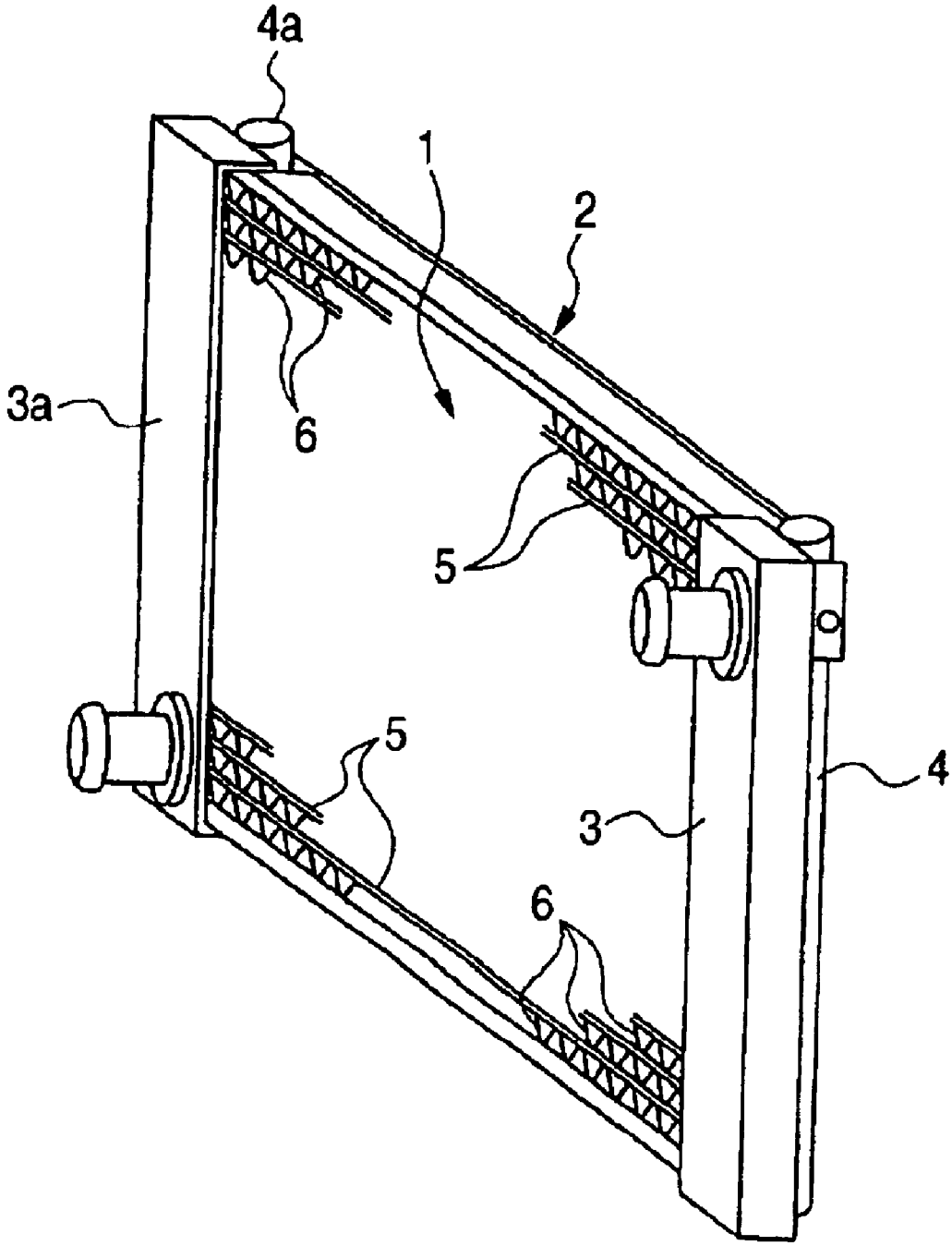
FIG. 14 PRIOR ART
FIG. 14 is a perspective view showing an example of an integrated heat exchanger according to a related art.
Figure 15:
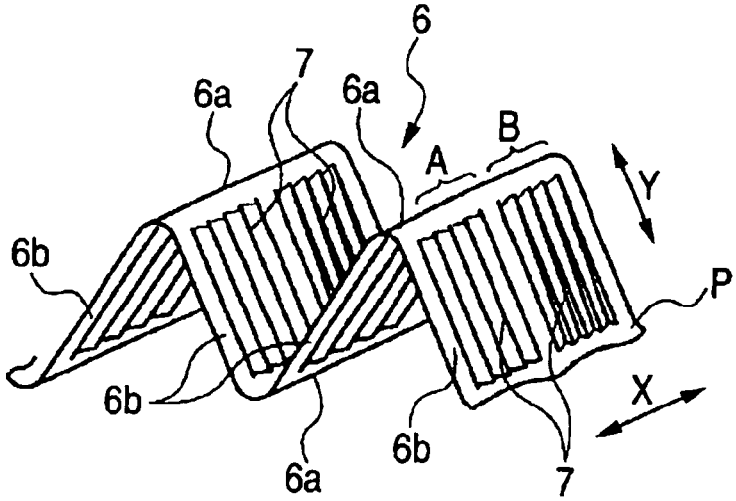
FIG. 15 PRIOR ART
FIG. 15 is a perspective view showing main portions of a fin structure according to the related art.
Figure 16:
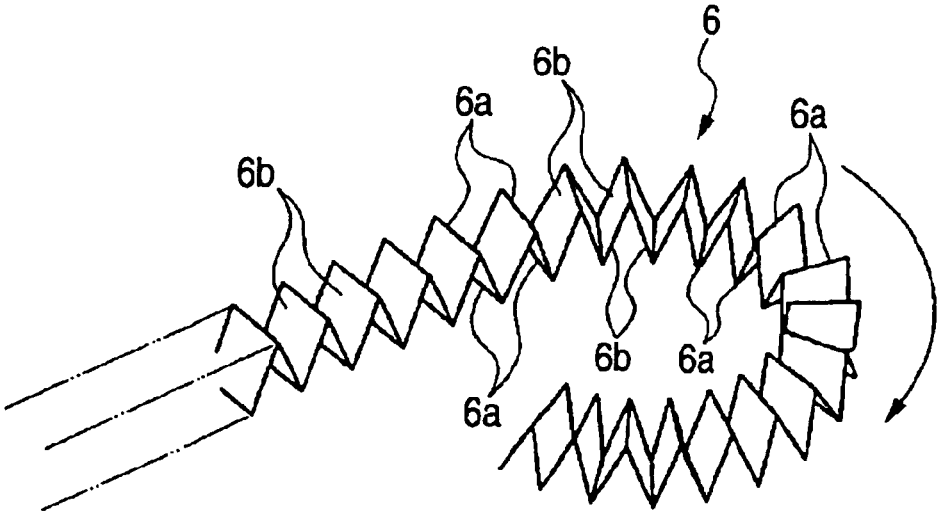
FIG. 16 PRIOR ART
FIG. 16 is a perspective view showing a curved state of a fin according to the related art.

FIGS. 11 to 13 show a second embodiment of the invention. The components identical with those of the first embodiment are denoted by the same reference numeral, and duplicated description will be omitted.

FIG. 11 is a front view of an integrated heat exchanger. FIG. 12 is an enlarged section view taken along a line D—D in FIG. 11. FIG. 13 is a diagram showing cooling performance of the integrated heat exchanger. An integrated heat exchanger 10*a* according to the second embodiment is configured by stacking a first radiator 20*a* and a second radiator 30*a*, which function as heat exchangers through which the same heat exchange medium (cooling water) is circulated.

In the first and second radiators 20*a*, 30*a*, the cooling water is flown from the first radiator 20*a*, which is on one end side in the stacking direction, to the second radiator 30*a*,which is on the other side. In the embodiment, the first and second radiators 20*a*, 30*a* are provided with a common tank 100, which serves as a coupling flow portion.

As shown in the left half of FIG. 11 and in FIG. 12, the first radiator 20*a* includes the common tank 100, a dedicated first tank 101, which is disposed to be opposite to one half side (the right side in FIG. 12) of the common tank 100, a plurality of tubes 102, which communicate between the common tank 100 and the first tank 101, and first fins 103, which are incorporated between the tubes 102, respectively.

The second radiator 30*a* is configured in a substantially similar manner as the first radiator 20*a*. As shown in the right half of FIG. 11 and in FIG. 12, a dedicated second tank 104 is disposed so as to be opposite to the other half side (the left side in FIG. 12) of the common tank 100. Second fins 106 are incorporated between a plurality of tubes 105, which communicate between the common tank 100 and the second tank 104.

In the first tank 101 of the first radiator 20*a*, as shown in FIG. 11, an inlet 107 for the cooling water is disposed in the vicinity of an end of the one side (the left side in the figure) in the longitudinal direction (the lateral direction in the figure) of the first tank 101. An outlet 108 for the cooling water is disposed in the vicinity of an end of the other side (the right side in the figure) in the longitudinal direction of the second tank 104 of the second radiator 30*a*. The cooling water, which is introduced from the inlet 107, is flown from the first tank 101 to the common tank 100 through the tubes 102. Thereafter, the cooling water makes a U-turn in the common tank 100 to be passed through the tubes 105 and then flown into the second tank 104. The cooling water, which is flown into the second tank 104, is discharged from the outlet 108.

The integrated heat exchanger 10*a* according to the second embodiment is produced in a similar manner as the first embodiment. Namely, in the fin forming step W1, the first and second fins 103, 106 of the first radiator 20*a* and the second radiator 30*a* are formed as corrugated fins in a connected state, and temporarily attached between the tubes 102 and the tubes 105 in the fin attaching step W2. Thereafter, the first and second fins 103, 106 are brazed in the fin fixing step W3, and separated from each other along a parting portion 109 (see FIG. 12) in the fin separating step W4.

Accordingly, in the integrated heat exchanger 10*a* of the second embodiment, the common tank 100 of the first and second radiators 20*a*, 30*a*, which are coupled to each other in the stacking direction functions as a coupling flow portion so that the cooling water is flown through the first radiator 20*a* on one end side of the stacked radiators and then through the second radiator 30*a* on the other end side. Therefore, the cooling water is twice other end side. Therefore, the cooling water is twice cooled by the first and second radiators 20*a*, 30*a*, so that the cooling efficiency is improved. As a result, it is possible to provide a heat exchanger, which is compact and in which the cooling effect can be enhanced.

As described above, the integrated heat exchanger 10*a* can be made compact while attaining a high cooling effect. Therefore, the mountablity of the heat exchanger into a narrow engine room of a vehicle is improved. For example, the integrated heat exchanger can exhibit high performance as a heat exchanger for an FCV (fuel cell vehicle).

In an FCV, it is required to dissipate the quantity of heat, which is about two times that of a conventional engine, and the upper limit of the water temperature is set to 80° C. which is lower by 15° C. than that in a conventional engine. Therefore, it is impossible to dissipate the quantity of heat, which is generated by a cell stack and is as large as 60 to 90 kW, by a quantity of airflow produced in a usual vehicle.

In order to enhance the cooling efficiency, conventionally, the radiator area is increased by inclining the radiator in the longitudinal direction or adding a subradiator, whereby the quantity of airflow is increased. Alternatively, the quantity of airflow is increased by increasing the size of a motor fan or disposing a ram pressure damper. As a result, there arise problems in that the configuration is complicated and increased in size and that it is difficult to lay out a narrow engine room. All of such problems of the conventional art can be solved by the integrated heat exchanger 10*a* according to the embodiment, which is compact and in which the cooling effect is high.

In the integrated heat exchanger 10*a* according to the embodiment, as shown in FIG. 13, in the case where the inlet temperature of the cooling water introduced into the inlet 107 is 80° C., the cooling water can be cooled so that the water temperature in the turning portion of the common tank 100 is 72.8° C. and the outlet temperature in the outlet 108 is 63° C. Therefore, the integrated heat exchanger can sufficiently function as a heat exchanger for an FCV while ensuring a high heat exchanger effectiveness of a temperature difference of 17° C.

The above-mentioned values are obtained by a test conducted under the conditions that the outside air temperature is 40° C., the airflow velocity is 8.5 m/sec., the flow quantity of the cooling water is 75 L/min. The integrated heat exchanger exerts a performance of 90 kW. Under the condition of the above outside air temperature, the intermediate air temperature between the first and second radiators 20*a*, 30*a* is 55.3° C., and the outlet air temperature is 66.9° C. In the first and second radiators 20*a*, 30*a*, each of the tubes 102, 105 is set to have a thickness of 27 mm in the stacking direction.

In the second embodiment, the cooling water may be purified water so that the tubes 102, 105 are prevented from clogging. In this case, the tubes 102, 105 can be narrowed in a range where coating of the inner face is enabled, whereby the performance can be further enhanced. In this case, in order to reduce the flow quantity of the water in the tubes 102, 105, it is preferable to employ a layout of horizontal flow in which the tubes 102, 105 are horizontally placed.

The method for producing an integrated heat exchanger, and the integrated heat exchanger produced by the method according to the invention have been described with taking the integrated heat exchangers 10 and 10*a* according to the first and second embodiments as examples. The invention is not limited to the embodiments, and can be implemented in various embodiments without departing from the spirit of the invention.

What is claimed is:

1. A method for producing an integrated heat exchanger in which a plurality of heat exchangers each having fins for heat radiation are coupled to each other in a stacking direction, the method comprising the steps of:

forming the fins of the heat exchangers into a connected state where the fins are connected to each other via a parting portion;

temporarily attaching the fins in the connected state to the heat exchangers, respectively;

heating the integrated heat exchanger in which the fins are temporarily attached, to braze the fins to the heat exchangers, respectively; and separating the tins in the connected state from each other along the parting portion.

2. The method according to claim 1 further comprising the steps of applying a fusing material to the parting portion before the heating step, the fusing material fusing the fins when being heated.

3. The method according to claim 2, wherein the fins are made of aluminum thin sheets;

wherein the fusing material is a brazing material; and wherein in the applying step, the brazing material is applied to the parting portion so that an amount of the brazing material is larger than a brazing allowable amount at which a brazing process can be normally performed.

4. The method according to claim 3, wherein the applying step includes the steps of:

applying a brazing material to the parting portion; and applying a flux material to the fins in a strip-like shape.

5. The method according to claim 1, further comprising the steps of forming each of fins into a corrugated shape in which a flat portion having louvers and a bent portion are alternately formed, wherein the parting portion is a perforated line in which connecting parts are formed at the bent portion.

6. The method according to claim 1, further comprising the steps of providing a coupling flow portion with the heat exchangers, wherein the coupling flow portion flows a heat exchange medium from the heat exchanger on one end side in the stacking direction to the heat exchanger on another end side in the stacking direction therethrough.

* * * * *